US009599334B2

(12) United States Patent
Goldring et al.

(10) Patent No.: US 9,599,334 B2
(45) Date of Patent: Mar. 21, 2017

(54) NOZZLE FOR POWER STATION BURNER AND METHOD FOR THE USE THEREOF

(71) Applicant: RJM Corporation (EC) Limited, Winchester (GB)

(72) Inventors: John Goldring, Winchester (GB); Stephen Billett, Winchester (GB); Matthew Shields, Winchester (GB)

(73) Assignee: RJM CORPORATION (EC) LIMITED, Winchester (GB)

( * ) Notice: Subject to any disclaimer, the term of this patent is extended or adjusted under 35 U.S.C. 154(b) by 370 days.

(21) Appl. No.: 14/261,978

(22) Filed: Apr. 25, 2014

(65) Prior Publication Data

US 2014/0322658 A1 Oct. 30, 2014

(30) Foreign Application Priority Data

Apr. 25, 2013 (GB) ..... 1307517.1

(51) Int. Cl.
*F23D 1/00* (2006.01)
*F23D 1/02* (2006.01)

(52) U.S. Cl.
CPC ..... *F23D 1/00* (2013.01); *F23D 1/02* (2013.01); *F23D 91/00* (2015.07); *F23D 2201/20* (2013.01)

(58) Field of Classification Search
CPC ... F23D 1/00; F23D 91/00; F23D 1/02; F23D 2201/20
See application file for complete search history.

(56) References Cited

U.S. PATENT DOCUMENTS 2,483,728 A 10/1949 Glaeser
3,387,574 A 6/1968 Mullen
4,501,204 A 2/1985 McCartney et al.
4,690,075 A 9/1987 Vidal et al.
4,899,670 A 2/1990 Hansel
4,930,430 A 6/1990 Allen et al.
5,199,357 A 4/1993 Garcia-Mallol
(Continued)

FOREIGN PATENT DOCUMENTS

DE 3403981 8/1985
EP 0428932 5/1991
(Continued)

OTHER PUBLICATIONS

European Search Report for EP Application No. 14166113 dated Feb. 5, 2015.
European Search Opinion for EP Application No. 14166113.2 dated Feb. 5, 2015.
European Search Report and Annex to the European Search Report dated Feb. 12, 2015 for European Patent Application No. 14188201.
Search Report for GB1317795.1 dated Mar. 19, 2014.
1. Cornwell, S. (2012). Biomass—A Lifeline for the Coal Fired Generation or a False Dawn? Retrieved Sep. 14, 2012, from the company: RJM Corporation (EC) Ltd, Winchester.
(Continued)

*Primary Examiner* — Alfred Basichas
(74) *Attorney, Agent, or Firm* — Fleit Gibbons Gutman Bongini & Bianco PL; Paul D. Bianco; Gary S. Winer

(57) ABSTRACT

A burner nozzle for delivering fuel to a burner flame in a furnace includes an inner cylinder and an outer cylinder that are both hollow. The inner cylinder is at least partly disposed within the outer cylinder and axially aligned with it, and is movable in an axial direction relative to the outer cylinder. One end of the inner cylinder has at least one outward projection extending in a radial direction from the outer surface of the cylinder, this projection serving to decrease the free cross-sectional area between the inner cylinder and the outer cylinder at that end of the inner cylinder.

19 Claims, 7 Drawing Sheets

(56) References Cited

U.S. PATENT DOCUMENTS

| | | | | |
|---|---|---|---|---|
| 5,205,226 | A | 4/1993 | Kitto | |
| 5,415,114 | A | 5/1995 | Monro et al. | |
| 5,429,060 | A | 7/1995 | Tokuda et al. | |
| 5,568,777 | A | 10/1996 | Breen et al. | |
| 5,769,008 | A | 6/1998 | Finker et al. | |
| 6,938,560 | B2 | 9/2005 | Okazaki et al. | |
| 7,392,752 | B2 | 7/2008 | Okazaki et al. | |
| 8,353,698 | B2 | 1/2013 | Moberg | |
| 2002/0115033 | A1 | 8/2002 | Hallit | |
| 2004/0185401 | A1 | 9/2004 | Moberg | |
| 2004/0185402 | A1 | 9/2004 | Moberg | |
| 2004/0187751 | A1 | 9/2004 | Okazaki et al. | |
| 2005/0002841 | A1 | 1/2005 | Moberg | |
| 2005/0257721 | A1 | 11/2005 | Okazaki et al. | |
| 2007/0272132 | A1* | 11/2007 | Marx | F23D 1/02 110/263 |
| 2008/0283039 | A1 | 11/2008 | Waltz et al. | |
| 2012/0145052 | A1 | 6/2012 | Levasseur et al. | |
| 2012/0152158 | A1 | 6/2012 | Matsumoto et al. | |
| 2015/0099233 | A1 | 4/2015 | Goldring | |

FOREIGN PATENT DOCUMENTS

| | | |
|---|---|---|
| EP | 1435485 | 7/2004 |
| GB | 2115133 | 9/1983 |
| JP | S5833019 | 2/1983 |
| JP | S5921910 | 2/1984 |
| JP | S6176815 | 4/1986 |
| SU | 606035 | 5/1978 |
| SU | 861845 | 9/1981 |
| SU | 1150432 | 4/1985 |
| WO | 2004085922 | 10/2004 |
| WO | 2004111538 | 12/2004 |
| WO | 2005001338 | 1/2005 |
| WO | 2009130857 | 10/2009 |

OTHER PUBLICATIONS

2. Emissions Trading System (EU ETS). (Oct. 31, 2012). Retrieved Nov. 6, 2012, from http://ec.europa.eu/clima/policies/etst/index_en.htm.
5. Biomass. (n.d). Retrieved Nov. 18, 2012, from http://www.eon-uk.com/generation/1569.aspx.
6. REN21. (1998). Renewables 2012, Global Status Report. Retrieved from http://www.map.ren21.net/GSR/GSR2012.pdf.
7. Our History. (n.d). Retrieved Jan. 25, 2013, from http://www.draxgroup.plc.uk/biomass/cofiring_plans/.
8. Tilbury Power Station. (n.d). Retrieved Dec. 3, 2012, from http://www.rwe.com/web/cms/en/97606/rwe-npower/about-us/our-businesses/power-generation/tilbury/.
9. Images & Videos. (n.d). Retrieved Mar. 19, 2013, from http://www.co2crc.com.au/imagelibrary3/capture.php.
10. Renewable & Alternative Energy Fact Sheet. (2009). Retrieved Mar. 19, 2013, from http://pubs.cas.psu.edu/freepubs/pdfs/uc203.pdf.
11. Biomass Fuel of the Future. (n.d). Retrieved Mar. 19, 2013, from http://www.biomass-boiler.co/biomass-fuel/.
12. Coal. (n.d). Retrieved Mar. 19, 2013, from http://www.chemistryexplained.com/photos/coal-3347.jpg.
13. Typical Calorific Values. (n.d). Retrieved Jan. 12, 2013, from http://www.biofuelsb2b.com/useful_info.php?page=Typic.
14. Coal Burner in Furnace in Power Station. (n.d). Retrieved Jan. 12, 2013, from http://www.visualphotos.com/image/2×4656220/coal_burner_in_furnace_in_power_station.
15. ROC Banding. (Jan. 6, 2009). Retrieved Sep. 14, 2012, from the company: RJM Corporation (EC) Ltd, Winchester.
16. Carbon Floor Price. (Dec. 2009). Retrieved Sep. 14, 2012, from the company: RJM Corporation (EC) Ltd, Winchester.
Search Report for GB1307517.1 dated Apr. 17, 2014.

* cited by examiner

BIOMASS FIRING MODE
COAL FIRING MODE 18
20
22
24
33
40
41

NOZZLE FOR POWER STATION BURNER AND METHOD FOR THE USE THEREOF

FIELD OF THE INVENTION

The present invention relates to a nozzle for a power station burner, in particular to a nozzle that is adjustable for different fuel types, and to a method for the use thereof.

BACKGROUND TO THE INVENTION

Biomass or waste fuels (e.g. wood pellets, wood chips, miscanthus, straw, olive cake, palm kernels, sugarcane, corncobs, groundnut shells, refuse derived fuel and solid recovered fuel) have become increasingly popular for use in firing power stations. However, they have not completely replaced coal, and so it is desirable to provide burners for power station furnaces that are able to be operated with both types of fuels.

Due to the different combustion characteristics of coal and biomass, the provision of such burners is technically challenging. In particular, it is desirable to provide burners that may be quickly and easily re-configured for use with a different fuel.

SUMMARY OF THE INVENTION

Biomass and coal fuels are typically delivered into a furnace in pulverised, particulate, or shredded form. The present inventors have found that a significant difference in the combustion characteristics of biomass and coal lies in the different particle velocities that are required to form a stable flame at the mouth of the burner.

Therefore, at its most general, the present invention may provide a fuel nozzle for a burner, in which the free cross-sectional area of the nozzle at its exit is adjustable. The free cross-sectional area denotes the portion of the nozzle exit that is available for particle flow therethrough, that is, the portion of the nozzle exit that is unobstructed. As is well-known in this technical field, a high free cross-sectional area will result in low fuel particle velocity. Conversely, a low free cross-sectional area will result in high fuel particle velocity.

The free cross-sectional area of the exit is adjustable by providing one or more obstructions that may be moved between a position at the nozzle exit and a position upstream of the nozzle exit. It is thought that when the one or more obstructions are located upstream of the nozzle exit, the fuel particles by-passing the obstruction have sufficient time to re-distribute around the nozzle area and slow down to the desired velocity once they reach the nozzle exit. Conversely, when the obstruction is positioned at the nozzle exit, the particles exit the nozzle with high velocity.

It is desirable that the mechanism for adjusting the free cross-sectional area of the nozzle exit is compact and interferes as little as possible with the operation of the burner.

Therefore, in a first aspect, the present invention may provide a burner nozzle for delivering fuel to a burner flame in a furnace, the nozzle comprising an inner cylinder and an outer cylinder, the inner and outer cylinders being hollow and the inner cylinder being at least partly disposed within the outer cylinder and axially aligned therewith, the inner cylinder being movable in an axial direction relative to the outer cylinder, wherein one end of the inner cylinder has at least one outward projection extending in a radial direction from the outer surface thereof, the at least one outward projection serving to decrease the free cross-sectional area between the inner cylinder and the outer cylinder at that end of the inner cylinder.

In general, the at least one outward projection is located at the downstream end of the inner cylinder, that is, at the end facing the nozzle exit.

This arrangement allows the free cross-sectional area at the nozzle exit to be adjusted relatively easily, simply by moving the inner cylinder along a longitudinal axis of the burner. There is no need to dismantle or substitute any of the existing parts of the burner with alternative or new parts. This helps to provide the burner with a high level of flexibility, such that it can easily be adapted to burn a different fuel. In certain cases this arrangement may allow adjacent burners to be operated under different modes of operation, e.g. such that each burner burns a different fuel.

Typically, the upstream end of the inner cylinder protrudes from the burner, and so the axial position of the cylinder may be manipulated by means of this protruding end. Effectively, therefore, the burner configuration may be adjusted externally to the burner.

Typically, the nozzle comprises a plurality of outward projections disposed at one end of the inner cylinder and projecting in a radial direction from the outer surface thereof. In general, these projections are disposed in a radially symmetrical distribution about the inner cylinder. This helps to ensure that the fuel particles leave the nozzle exit in a uniformly distributed manner.

Preferably, the at least one outward projection is configured such that, when viewed along an axial direction of the nozzle, the outward projection tapers in a radially inward direction of the nozzle. This helps to ensure that the radially inner portion of the nozzle exit is not obstructed excessively and that there is an acceptable fuel particle density around the longitudinal axis of the burner.

Preferably, the at least one outward projection subtends an angle of between 30° and 50', more preferably between 35° and 45°, at the longitudinal axis of the nozzle.

Preferably, there is sufficient clearance between the inner surface of the outer cylinder and the at least one outward projection to allow for dynamic adjustment of the axial position of the inner cylinder. Typically, the gap between the inner surface of the outer cylinder and the at least one outward projection is less than 5 mm, preferably less than 4 mm.

Typically, the at least one outward projection is provided with a ridge at its radially outermost extent, the ridge extending in an axial direction of the nozzle and contacting the inner surface of the outer cylinder. This helps to ensure that the inner cylinder remains centred within the nozzle.

Typically, the free cross-sectional area between the inner cylinder and the outer cylinder at the location of the at least one outward projection is less than 80%, preferably less than 60%, more preferably less than 50%, of the total cross-sectional area between the inner cylinder and the outer cylinder. Thus, the arrangement according to the first aspect of the invention is capable of providing large differences in free cross-sectional area at the nozzle exit, so as to adapt the burner for use with different fuels.

Typically, the outer cylinder is provided at one end thereof with at least one inward projection extending in a radially inward direction thereof. In general, when viewed along the longitudinal axis of the nozzle, the inward projection tapers in a radially inward direction of the nozzle. Preferably, the inward projection subtends an angle in the range of 10° to 20°, more preferably 12° to 18°, at the longitudinal axis of the nozzle.

In certain embodiments, the inward projection extends less than half the distance between the outer cylinder and the inner cylinder. This helps to ensure that there is an acceptable fuel density around the longitudinal axis of the burner.

In general, the outer cylinder is provided at one end thereof with a plurality of inward projections extending in a radially inward direction thereof. Typically, the plurality of inward projections are arranged in a radially symmetrical distribution around the outer cylinder.

The inward projections may help to provide radially distributed fuel-rich and fuel-lean zones immediately downstream of the nozzle exit. The fuel-rich zones tend to provide oxygen-lean environments within the resultant flame, such that $NO_x$ emissions are reduced. Nitrogen oxides are pollutants that are regulated globally and so it is desirable to inhibit their formation.

In general, the nozzle has equal numbers of inward projections and outward projections, the inward and outward projections being arranged such that, when viewed along a longitudinal axis of the nozzle, the inward projections are each disposed between a pair of adjacent outward projections. Typically, the inward projections are each disposed midway between a pair of adjacent outward projections.

It has been found that different fuels require different airflow patterns around the burner flame in order to achieve a good balance of efficient combustion with low levels of harmful emissions (such as $NO_x$ emissions). Typically, a burner is provided with two air sources for mixing with the fuel as it exits the nozzle. A first, radially inward air source helps to create an internal recirculation zone (IRZ) immediately downstream of the nozzle exit, while a second radially outward air source provides oxygen to allow combustion of the fuel as it escapes the IRZ.

Therefore, in a second aspect, the present invention may provide a burner comprising a nozzle according to the first aspect of the invention, and first and second air sources, the air sources each being disposed around the nozzle in a ring shape that is centred on the longitudinal axis of the nozzle, wherein the flow rate from the first air source is adjustable relative to the flow rate from the second air source.

The first and second air sources are typically provided with swirlers to give angular momentum to the air flow passing through them.

In a third aspect, the present invention may provide a method of adjusting the operating conditions of a burner for use with different fuels, comprising the steps of providing a burner comprising a nozzle according to the first aspect of the invention;

moving the inner cylinder of the nozzle along its longitudinal axis between a first position in which the outward projections are axially aligned with an end of the outer cylinder, and a second position in which the outward projections are axially displaced from an end of the outer cylinder.

Typically, the burner is a burner according to the second method of the invention, and the method comprises the further step of adjusting the flow rate from the first air source relative to the second air source.

BRIEF DESCRIPTION OF THE DRAWINGS

The invention will now be described by way of example with reference to the following Figures in which.

DETAILED DESCRIPTION OF THE INVENTION

Figure 1:
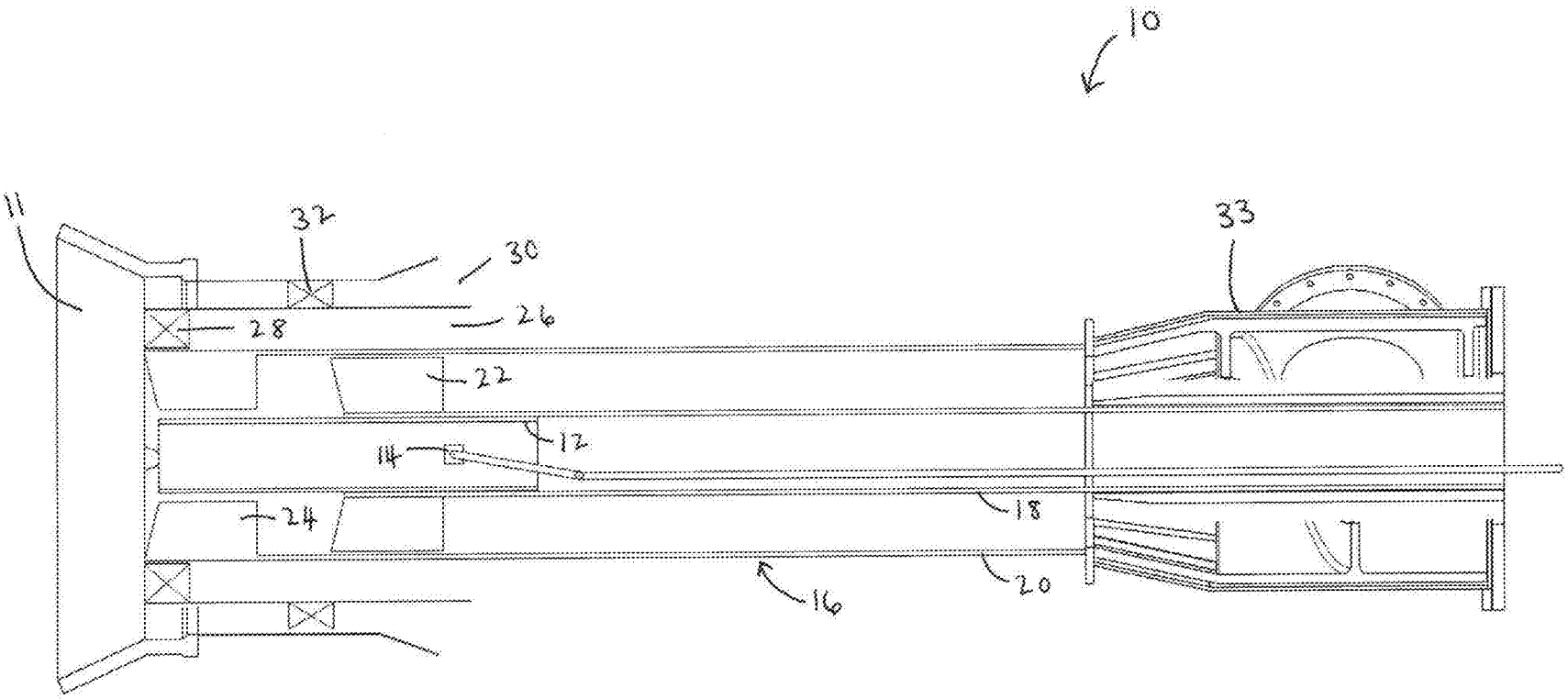
FIG. 1 shows a schematic cross-sectional view of a burner comprising a nozzle according to an embodiment of the first aspect of the invention, the nozzle being arranged according to a first configuration.

Referring to FIG. 1, a burner 10 is mounted in the wall of a furnace (not shown) and has a flame side 11 that faces into the interior of the furnace. The burner comprises a plurality of concentric tubes. A core air tube 12 houses a gas igniter and an oil burner 14. A ring-shaped nozzle 16 is disposed around the core air tube 12 and is concentric with the core air tube. The nozzle 16 comprises an inner cylinder 18 and an outer cylinder 20 that is concentric with the inner cylinder 18.

The end of the inner cylinder 18 that is adjacent the core air tube is provided with outward projections 22 that extend in a radially outward direction of the cylinder 18. The outward projections 22 also extend axially along a limited portion of the length of the inner cylinder 18. The surfaces of the outward projections that face towards the interior of the furnace (that is, in a downstream direction of the nozzle) are oriented at an oblique angle of 58° relative to the longitudinal axis of the burner. Effectively, these surfaces together provide an interrupted generally concave surface about the longitudinal axis of the burner. The surfaces of the outward projections that face away from the interior of the furnace (that is, in an upstream direction of the nozzle) extend in a lateral direction from the burner axis.

The end of the outer cylinder 20 at the nozzle exit (that is, the end adjacent to the core air tube 12) is provided with inward projections 24 that extend in a radially inward direction of the outer cylinder 20. The inward projections 24 also extend axially along a limited portion of the length of the outer cylinder 20. The surfaces of the inward projections that face towards the interior of the furnace (that is, in a downstream direction of the nozzle) are oriented at an oblique angle of 58° relative to the longitudinal axis of the burner. Effectively, these surfaces together provide an interrupted generally concave surface about the longitudinal axis of the burner. The surfaces of the outward projections that face away from the interior of the furnace (that is, in an upstream direction of the nozzle) extend in a lateral direction from the burner axis.

FIG. 1 shows the nozzle arranged in a first configuration, that is, the position of the inner cylinder 18 along the longitudinal axis of the burner is such that the outward projections lie within the burner and are displaced from the nozzle exit.

A first air source 26 is provided in the shape of a ring that is disposed outwardly of the outer cylinder 20 and is concentric with it. The first air source has a swirler 28 to provide angular momentum to the air travelling through it.

A second air source 30 is provided in the shape of a ring that is disposed outwardly of the first air source 26 and is concentric with it. The second air source has a swirler 32 to provide angular momentum to the air travelling through it.

A fuel connection 33 provides a path for delivering fuel to the nozzle.

Figure 2:
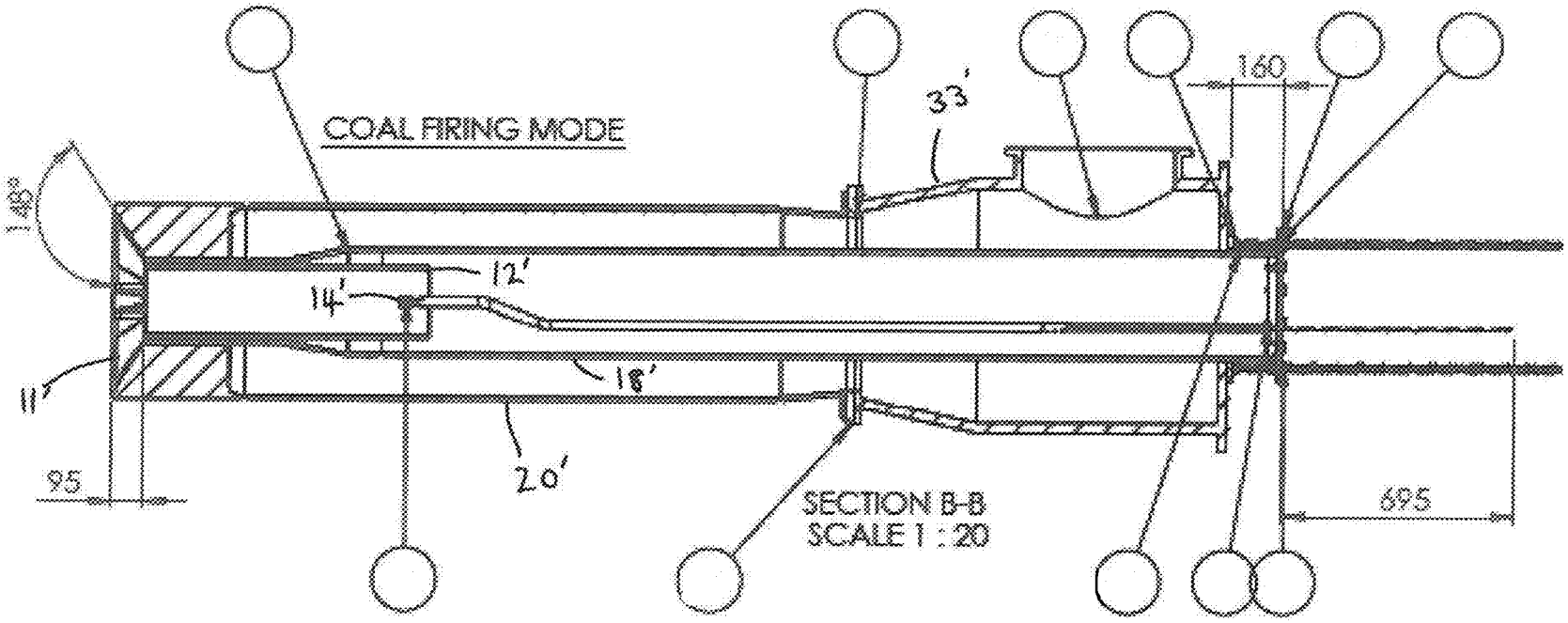
FIG. 2 shows a schematic cross-sectional view of a nozzle according to a second embodiment of the first aspect of the invention, arranged according to a second configuration.

FIG. 2 shows a nozzle in a second configuration. The nozzle has slightly different dimensions to the one shown in FIG. 1, but this is does not affect the basic principle of its operation. Features 11', 12', 14' 18', 20', and 33' correspond to features 11, 12, 14, 18, 20, and 33 of FIG. 1 respectively. The inner tube 18 is axially displaced relative to its position in FIG. 1, such that the outward projections are located at the nozzle exit. That is, the axial position of the outward projections corresponds to the axial position of the inward projections.

Figure 4:
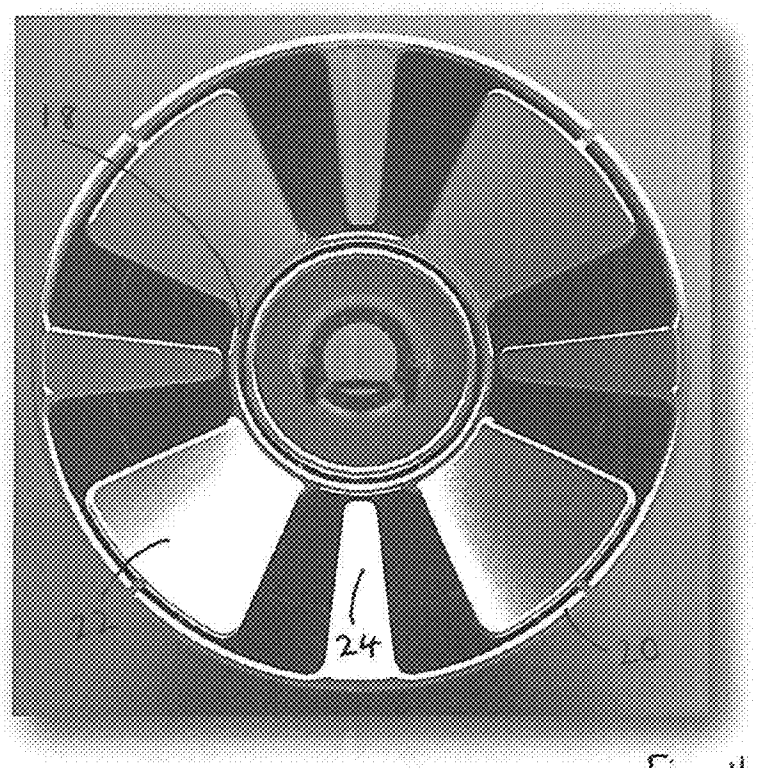
FIG. 4 shows a schematic plan view of the nozzle of the burner of FIG. 1 arranged in the second configuration.
Figure 3:
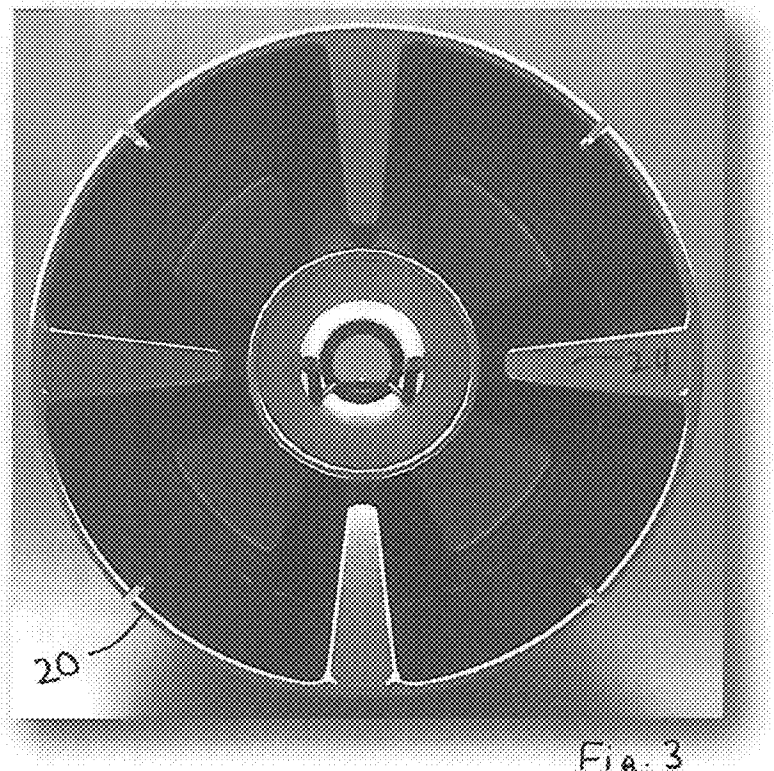
FIG. 3 shows a schematic plan view of the nozzle of the burner of FIG. 1 arranged in the first configuration.

FIGS. 3 and 4 show the nozzle of the burner of FIG. 1 in its first and second configurations respectively. The nozzle is viewed from the nozzle exit. Like numerals indicate like features.

The outward projections 22 are arranged radially symmetrically about the longitudinal axis of the burner. Similarly, the inward projections 24 are arranged radially symmetrically about the longitudinal axis of the burner. Each outward projection is positioned midway between adjacent inward projections, and each inward projection is positioned midway between adjacent outward projections.

Figure 5:
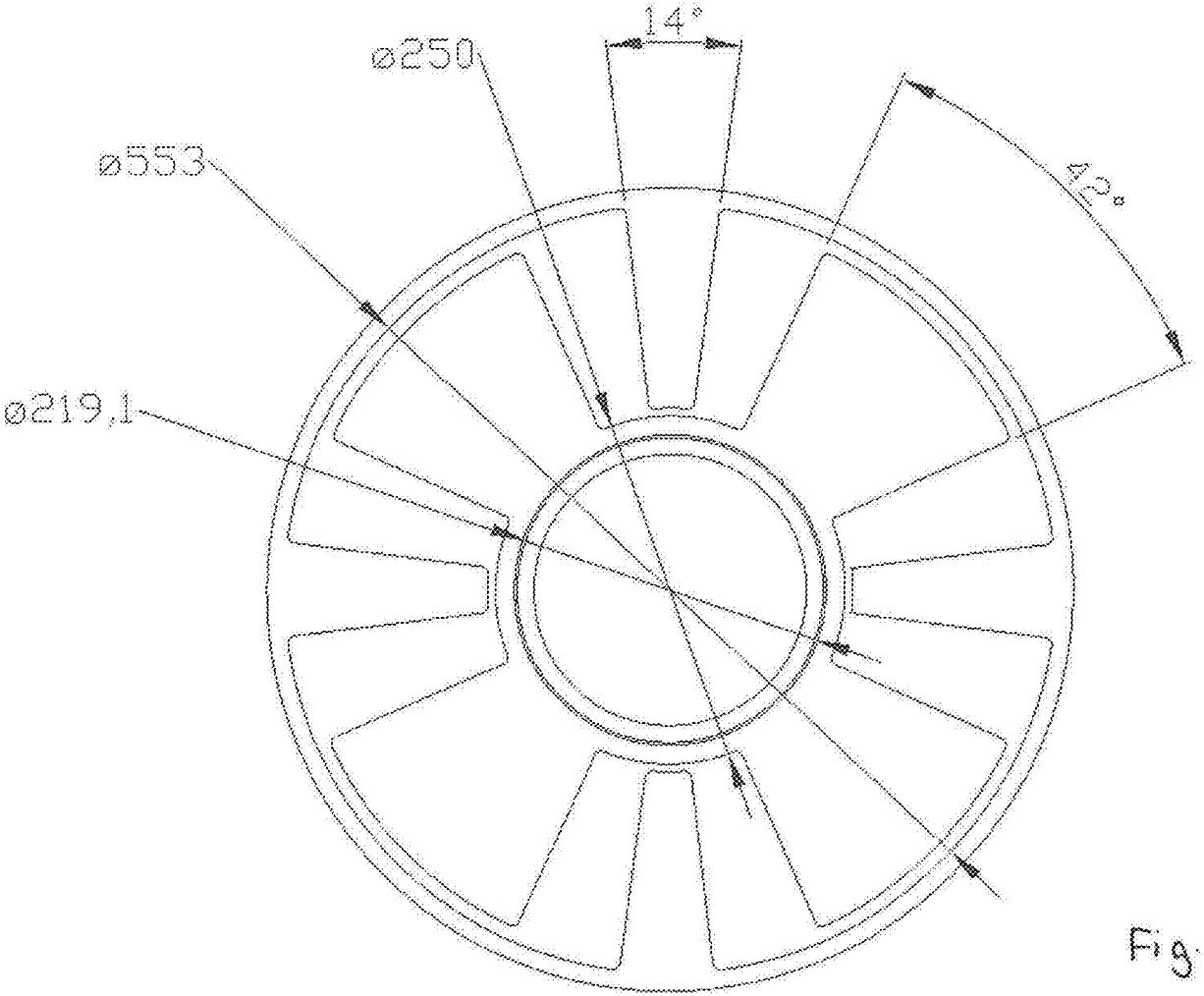
FIG. 5 shows a schematic view of FIG. 4, including the dimensions of the nozzle.

The outward projections 22 taper in a radially inward direction of the burner and each subtend an angle of 42° at the longitudinal axis of the burner. The inner projections 24 taper in a radially inward direction of the burner and each subtend an angle of 14° at the longitudinal axis of the burner. These dimensions are shown in FIG. 5.

When the outward and inward projections are axially aligned (as in FIG. 4), the free cross-sectional area at the nozzle exit is reduced by 42% relative to the configuration in which the outward projections are axially displaced upstream of the nozzle exit (as in FIG. 3).

Figure 6:
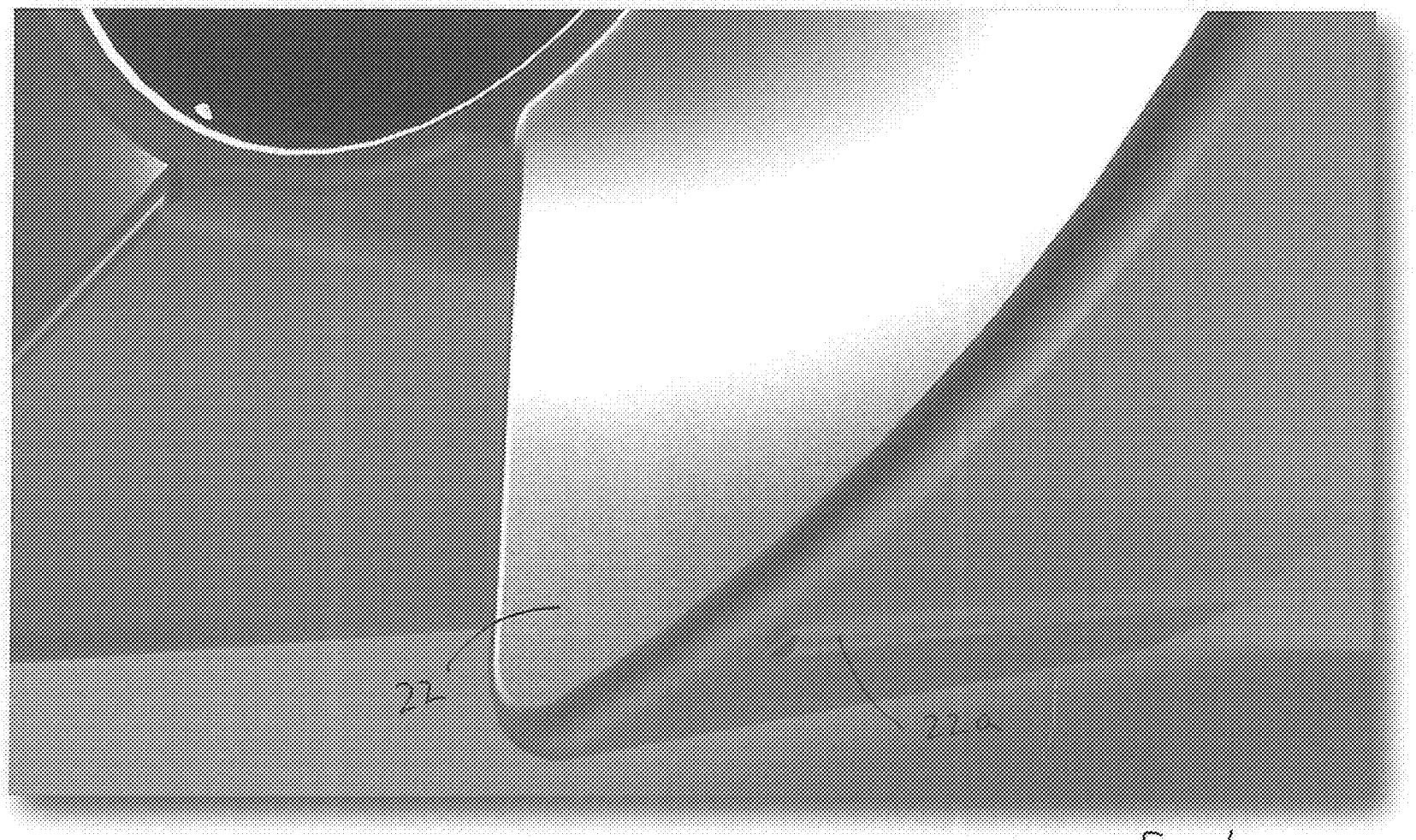
FIG. 6 shows a schematic perspective view of a magnified portion of the nozzle of the burner of FIG. 1.

There is a clearance of 3 mm between the outward projections and the inner surface of the outer cylinder, except where the outward projections are provided with ridges 22*a* that extend in a longitudinal direction of the burner and contact the inner surface of the outer cylinder (see FIG. 6).

Figures 7, 8, 9, 10:
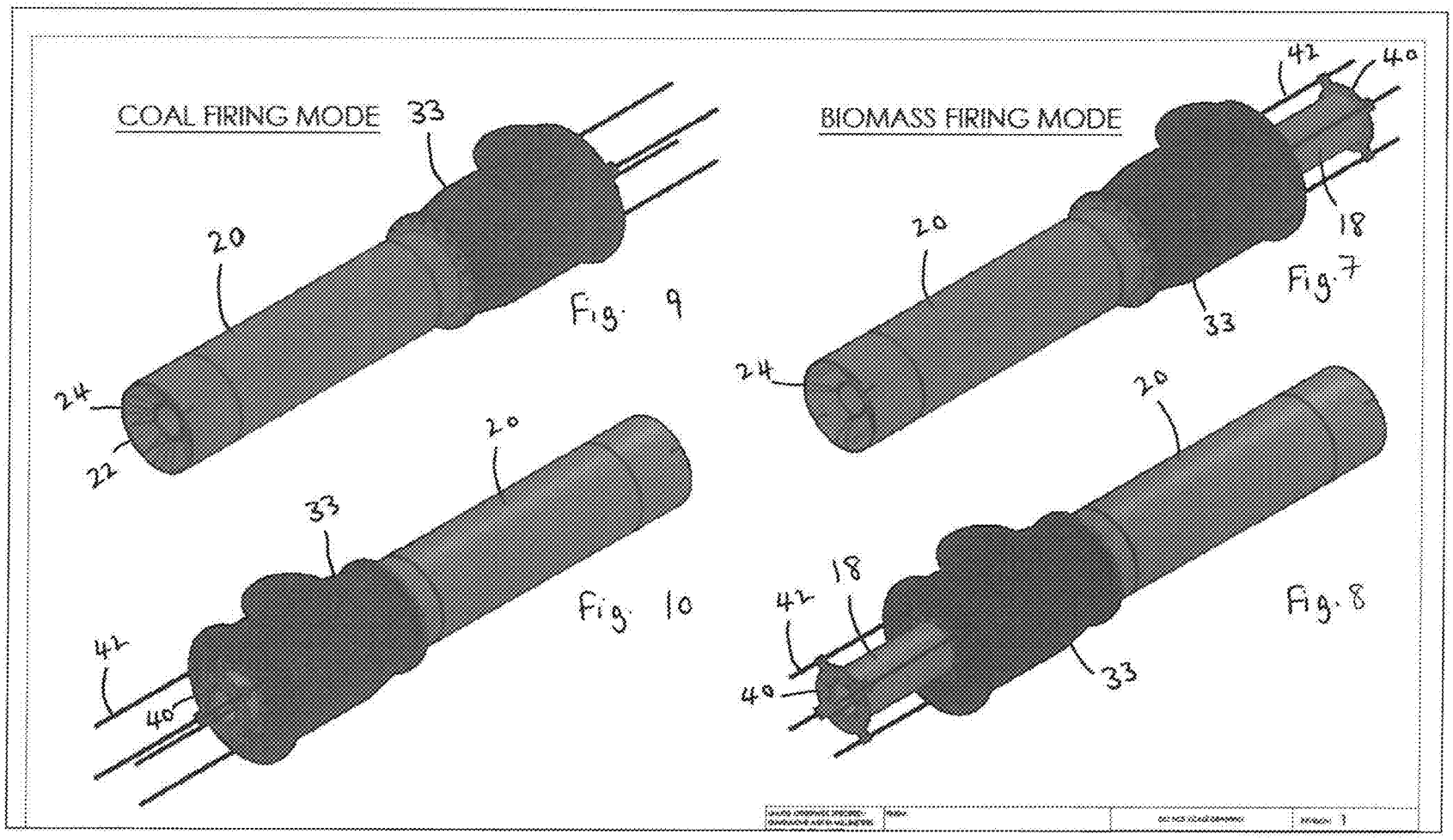
FIGS. 7 and 8 show schematic perspective views of the nozzle of the burner of FIG. 1 arranged according to the first configuration.
FIGS. 9 and 10 show schematic perspective views of the nozzle of the burner of FIG. 1, arranged according to the second configuration.

FIGS. 7 and 8 show the nozzle of the burner of FIG. 1 in its first configuration. Like numerals indicate like features.

FIGS. 9 and 10 show the nozzle of the burner of FIG. 1 in its second configuration. Like numerals indicate like features.

The upstream end of the inner cylinder 18 is provided with a flange 40 that is mounted on rods 42 that are secured to the fuel connection 33, the flange being slidable along those rods. In the second configuration of the nozzle, the downstream ends of the inner and outer cylinders coincide and the flange lies flush against the fuel connection 33 such that it may be bolted thereto. In the first configuration of the nozzle, the inner cylinder 18 is displaced relative to the outer cylinder in an axial direction of the nozzle. Thus the upstream end of the inner cylinder protrudes from the fuel connection 33.

Figure 11:
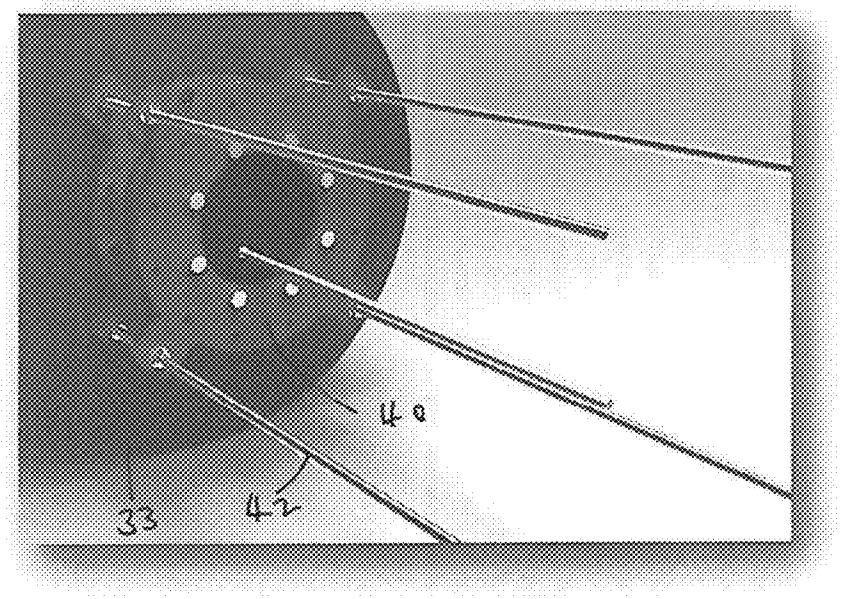
FIGS. 11 and 12 show schematic perspective view of the upstream ends of the nozzles of FIGS. 8 and 10 respectively.
Figure 12:
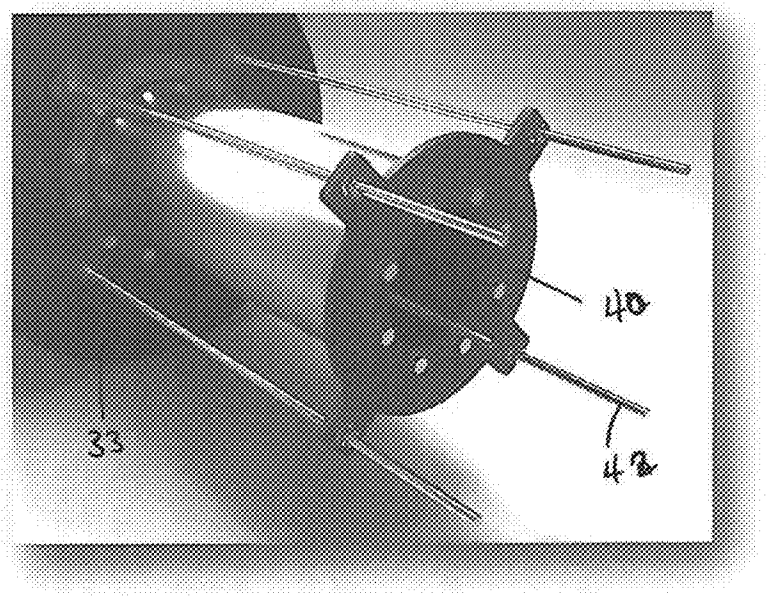

FIGS. 11 and 12 show detail views of the upstream portions of FIGS. 8 and 10 respectively. Like numerals indicate like features.

In use, the gas igniter lights the oil burner 14 which is used to pre-heat the boiler before the fuel can be fired. Core air is fed through the burner by a small fan (not shown) to aid combustion of the oil and gas.

Pulverised fuel (e.g. coal or biomass) is driven down the nozzle 16 into the furnace, conveyed by a carrier airstream. In the case that a low fuel exit velocity is desired (for example, in the case that biomass fuel is being used), the nozzle is arranged in its first configuration, i.e. the outward projections are located upstream of the nozzle exit. In this configuration, the free cross-sectional area at the nozzle exit is high, resulting in low fuel velocity. In the case that a high fuel exit velocity is desired (for example, in the case that coal fuel is being used), then the nozzle is arranged in its second configuration. In this configuration, the axial positions of the outward and inward projections 22,24 coincide, such that the free cross-sectional area at the nozzle exit is low, resulting in high fuel velocity.

Pre-heated air is driven through the first and second air sources. The relative air flow rates through the two sources are adjusted depending on the fuel type. For example, in the case that the fuel is biomass the flow rates of the first and second sources are in the ratio 2:1, whereas in the case that the fuel is coal, the ratio is reversed. The swirlers 28,32 provide the exiting air with angular momentum, so as to promote the formation of an internal recirculation zone at the burner exit.

The invention claimed is:

1. A nozzle for delivering fuel to a burner flame in a furnace, the nozzle comprising:

an outer cylinder having a hollow interior;

an inner cylinder having a hollow interior and at least partially disposed within the outer cylinder and aligned therewith, the inner cylinder movable in an axial direction relative to the outer cylinder;

at least one outward projection on one end of the inner cylinder, the at least one outward projection extending in a radial direction from an outer surface of the inner cylinder; and at least one inward projection on one end of the outer cylinder, the at least one inward projection extending and tapering in a radially inward direction of the outer cylinder along a longitudinal axis of the nozzle;

wherein the at least one outward projection decreases open space in a cross-sectional area between the inner cylinder and the outer cylinder at the end of the inner cylinder.

2. The nozzle according to claim 1, further comprising a plurality of outward projections disposed on the one end of the inner cylinder, each of the plurality of outward projections projecting in a radial direction from the outer surface of the inner cylinder.

3. The nozzle according to claim 2, wherein the plurality of outward projections are disposed in a radially symmetrical distribution around the outer surface of the inner cylinder.

4. The nozzle according to claim 1, wherein the at least one outward projection tapers in a radially inward direction of the nozzle along an axial direction of the nozzle.

5. The nozzle according to claim 1, wherein the open space in the cross-sectional area between the inner cylinder and the outer cylinder at an axial location of the at least one outward projection is 20-80% of a total cross-sectional area between the inner cylinder and the outer cylinder.

6. The nozzle according to claim 1, wherein 3-6 outward projections are disposed on the one end of the inner cylinder, the 3-6 outward projections projecting in a radial direction from the outer surface of the inner cylinder.

7. The nozzle according to claim 1, wherein the at least one inward projection extends less than half a distance between the outer cylinder and the inner cylinder.

8. The nozzle according to claim 1, further comprising a plurality of inward projections disposed on the one of end of the outer cylinder, each of the plurality of inward projections extending and tapering in a radially inward direction of the outer cylinder along a longitudinal axis of the nozzle.

9. The nozzle according to claim 8, wherein the plurality of inward projections are disposed in a radially symmetrical distribution around an inner surface of the outer cylinder.

10. The nozzle according to claim 1, wherein 3-6 inward projections are disposed on the one end of the outer cylinder, the 3-6 inward projections extending in a radially inward direction of the outer cylinder.

11. The nozzle according to claim 1, having equal numbers of inward projections and outward projections, the inward projections are each disposed between a pair of adjacent outward projections along a longitudinal axis of the nozzle.

12. The nozzle according to claim 1, wherein the inner cylinder is movable between a first position in which the at least one outward projection lies upstream of an exit of the nozzle and a second position in which the at least one outward projection is located at the exit of the nozzle.

13. A method for adjusting operating conditions of a burner for use with different fuels, the method comprising:
- providing a burner having a nozzle according to claim 1;
- moving the inner cylinder of the nozzle along its longitudinal axis between a first position in which the outward projections are axially aligned with the one end of the outer cylinder, and a second position in which the outward projections are axially displaced from the one end of the outer cylinder.

14. A burner comprising:
- a nozzle according to claim 1;
- a first ring-shaped air source disposed radially outwardly of the nozzle and centered on a longitudinal axis of the nozzle; and
- a second ring-shaped air source disposed radially outwardly of the nozzle and centered on the longitudinal axis of the nozzle,
- wherein a flow rate from the first air source is adjustable relative to a flow rate from the second air source.

15. A method for adjusting operating conditions of a burner for use with different fuels, the method comprising:
- providing a burner according to claim 14;
- moving the inner cylinder of the nozzle along its longitudinal axis between a first position in which the outward projections are axially aligned with the one end of the outer cylinder, and a second position in which the outward projections are axially displaced from the one end of the outer cylinder; and
- adjusting the flow rate from the first air source relative to the second air source.

16. A nozzle for delivering fuel to a burner flame in a furnace, the nozzle comprising:
- an outer cylinder having a hollow interior;
- an inner cylinder having a hollow interior and at least partially disposed within the outer cylinder and aligned therewith, the inner cylinder movable in an axial direction relative to the outer cylinder;
- 3-6 outward projections on one end of the inner cylinder, the 3-6 outward projections extending in a radial direction from an outer surface of the inner cylinder; and
- 3-6 inward projections on one end of the outer cylinder, the 3-6 inward projections extending in a radially inward direction of the outer cylinder;
- wherein the 3-6 outward projections decrease open space in a cross-sectional area between the inner cylinder and the outer cylinder at the end of the inner cylinder.

17. A burner comprising:
- a nozzle according to claim 16;
- a first ring-shaped air source disposed radially outwardly of the nozzle and centered on a longitudinal axis of the nozzle; and
- a second ring-shaped air source disposed radially outwardly of the nozzle and centered on the longitudinal axis of the nozzle,
- wherein a flow rate from the first air source is adjustable relative to a flow rate from the second air source.

18. A method for adjusting operating conditions of a burner for use with different fuels, the method comprising:
- providing a burner according to claim 17;
- moving the inner cylinder of the nozzle along its longitudinal axis between a first position in which the outward projections are axially aligned with the one end of the outer cylinder, and a second position in which the outward projections are axially displaced from the one end of the outer cylinder; and
- adjusting the flow rate from the first air source relative to the second air source.

19. A nozzle for delivering fuel to a burner flame in a furnace, the nozzle comprising:
- an outer cylinder having a hollow interior;
- an inner cylinder having a hollow interior and at least partially disposed within the outer cylinder and aligned therewith, the inner cylinder movable in an axial direction relative to the outer cylinder;
- at least one outward projection on one end of the inner cylinder, the at least one outward projection extending in a radial direction from an outer surface of the inner cylinder; and
- at least one inward projection on one end of the outer cylinder, the at least one inward projection extending in a radially inward direction of the outer cylinder;
- wherein a number of inward projections is equal to a number of outward projections, the inward projections disposed between pairs of adjacent outward projections; and
- wherein the outward projections decrease open space in a cross-sectional area between the inner cylinder and the outer cylinder at the end of the inner cylinder.

* * * * *